US006504124B1

(12) United States Patent
Doak

(10) Patent No.: US 6,504,124 B1
(45) **Date of Patent: *Jan. 7, 2003**

(54) OPTICAL GLASS SORTING MACHINE AND METHOD

(75) Inventor: Arthur G. Doak, Nashville, TN (US)

(73) Assignee: Magnetic Separation Systems, Inc., Nashville, TN (US)

( * ) Notice: Subject to any disclaimer, the term of this patent is extended or adjusted under 35 U.S.C. 154(b) by 37 days.

This patent is subject to a terminal disclaimer.

(21) Appl. No.: 09/685,246

(22) Filed: Oct. 10, 2000

Related U.S. Application Data

(63) Continuation of application No. 09/183,349, filed on Oct. 30, 1998, now Pat. No. 6,144,004, and application No. 09/329,636, filed on Jun. 10, 1999, now Pat. No. 6,137,074.

(51) Int. Cl.[7] ..... B07C 5/342

(52) U.S. Cl. ..... 209/581; 209/588; 209/639; 356/240

(58) Field of Search ..... 209/576, 577, 209/580, 581, 582, 588, 639, 938; 356/239, 240

(56) References Cited

U.S. PATENT DOCUMENTS

| | | | |
|---|---|---|---|
| 4,131,540 | A | 12/1978 | Husome et al. |
| 4,352,430 | A | 10/1982 | Maier et al. |
| 4,657,144 | A | 4/1987 | Martin et al. |
| 4,699,510 | A | 10/1987 | Alguard |
| 4,919,534 | A | 4/1990 | Reed |
| 5,085,325 | A | 2/1992 | Jones et al. |
| 5,143,308 | A | 9/1992 | Hally et al. |
| 5,150,307 | A | 9/1992 | McCourt et al. |
| 5,315,384 | A | 5/1994 | Heffington et al. |
| 5,318,172 | A | 6/1994 | Kenny et al. |
| 5,333,739 | A | 8/1994 | Stelte |
| 5,335,791 | A | 8/1994 | Eason |
| 5,339,963 | A | 8/1994 | Tao |
| 5,398,818 | A | 3/1995 | McGarvey |
| 5,402,264 | A | 3/1995 | Wilbur et al. |
| 5,419,438 | A | 5/1995 | Squyres et al. |
| 5,440,127 | A | 8/1995 | Squyres |
| 5,443,164 | A | 8/1995 | Walsh et al. |
| 5,464,981 | A | 11/1995 | Squyres et al. |
| 5,469,973 | A | 11/1995 | Booth et al. |
| 5,481,864 | A | 1/1996 | Wright |

(List continued on next page.)

OTHER PUBLICATIONS

DE 44 17 257 A 1.
PCT/DE95/00966.

*Primary Examiner*—Tuan N. Nguyen
(74) *Attorney, Agent, or Firm*—Waddey & Patterson; Lucian Wayne Beavers

(57) ABSTRACT

A glass sorting machine optically sorts glass cullet according to different color characteristics by irradiating the cullet with red, green and blue light as the cullet are passed through a sensing region between a light source and light sensors responsive to the different light colors. The attenuation levels of the different light colors are measured by the sensors as the cullet passes through the sensing region. The machine analyzes the attenuation levels to determine the color characteristics of the cullet. A collimator is typically used to enhance shadow definition. In one embodiment, a pixel grid map is made of the sensing region and each cullet that passes through the sensing region. Mapped on to each grid is a red, green, and blue digital signal. Attenuated signals are compared against baseline values to determine the attenuation for given cullet. The pixel grid map may be used with a data erosion technique to compensate for refraction. To reduce errors associated with optical impurities, the machine normalizes the baseline values when cullet are not in the sensing region by taking the derivative of the sensed signal and normalizing the baseline signal when no cullet are present.

7 Claims, 3 Drawing Sheets

U.S. PATENT DOCUMENTS 5,501,344 A 3/1996 Kaiser et al.
5,512,758 A 4/1996 Kobayashi et al.
5,531,331 A 7/1996 Barnett
5,533,628 A 7/1996 Tao
5,555,984 A 9/1996 Sommer, Jr. et al.
5,632,381 A 5/1997 Thust et al.
5,675,416 A 10/1997 Campbell et al.
5,789,741 A 8/1998 Kinter et al.
5,794,788 A 8/1998 Massen
5,799,105 A 8/1998 Tao
5,813,542 A 9/1998 Cohn
5,848,706 A 12/1998 Harris
5,862,919 A 1/1999 Eason
5,884,775 A 3/1999 Campbell
5,894,938 A * 4/1999 Ichise et al. ..... 209/558 X
5,954,206 A 9/1999 Mallon et al.
5,966,217 A 10/1999 Roe et al.
5,979,240 A 11/1999 Rix et al.
6,144,004 A * 11/2000 Doak ..... 209/581

* cited by examiner

OPTICAL GLASS SORTING MACHINE AND METHOD

This is a continuation of my U.S. patent application Ser. No. 09/183,349 filed Oct. 30, 1998 now U.S. Pat. No. 6,144,004 and application Ser. No. 09/329,636 filed Jun. 10, 1999, issued Oct. 24, 2000 as U.S. Pat. No. 6,137,074.

BACKGROUND OF THE INVENTION

This present invention relates generally to sorting of waste and recyclable materials using optical techniques. More specifically, this invention relates to the sorting of glass cullet and similar items by measuring the attenuation of light radiated through the cullet.

In conjunction with a continuing worldwide need to preserve natural resources and reduce dependence on landfills and similar waste storage facilities, machines and methods have been devised for automated identification and sorting of waste materials. Among the waste materials of interest is glass cullet, e.g., small pieces of glass of varying characteristics that are distinguished by color. For example, a typical collection of glass cullet may include pieces of glass having green, red, and blue color components or combinations thereof Prior art glass sorting machines function by sliding the pieces of cullet down what is commonly called a "wearcover." At one or more locations along the wearcover, the cullet will slide under one or more light sources and over one or more light sensors or light receivers arranged to define a sensing area. The pieces of glass cutlet having different color characteristics will attenuate the light emitted from the light sources in different amounts. For instance, if a piece of red glass passes between red and green light sources and the light sensors, the green light, as measured by the light sensors, will be attenuated more than the red light.

Most prior art glass sorters have, in fact, employed optical techniques relying primarily on red and green LED light sources. The primary reason for this is that red and green LED's and sensors were the only colors readily available at economically feasible prices. Unfortunately, the use of only red and green light sources in glass sorting restricts the ability of the machine to accurately identify glass containing other color components. This has resulted in the inability of prior art glass sorter to reliably distinguish cullet having measurable level of a blue component. "Blues" (cullet containing a measurable level of a blue color component) are either discarded as waste along with other non-distinguishable impurities, or were mis-sorted in with another color if the "blue" contained a relatively small blue color component. This mis-sorting results in a less pure, lower quality sort, which leads to a lower quality recycled product. Thus, the economic value of the sorted lot, as well as the quality the final product, is lower due to mis-sorts.

Another drawback with prior art glass sorting machines is that a film of crud or other impurities slowly builds up on the wearcover, thereby blocking the light sensors. This buildup, overtime, attenuates all light wavelengths to a measurable level. The film buildup is a by-product of the dirt, sand, water and other material that the cullet sit in, or are exposed to, prior to sorting. Since the cullet are generally trash to be recycled, it is, generally, not cost effective to pre-clean the cullet.

Edge refraction and impurity adhesion also cause glass mis-sorts. Cullet are generally relatively small broken pieces of glass with edges facing a variety of different directions. Light is refracted off at different angles from the different edge angles. The edges also create a prism effect. Because the light is re-directed at different angles, the edges will appear opaque to a sensor. Since cutlet are typically one-half inch to two and one-half inch across with edges typically one-sixteenth to one-quarter inch deep, the amount of light refracted, relative to the amount of light passing through the cullet, is not insignificant. This can lead to incorrect color selection and sorting of the cullet or rejection of cullet as foreign matter.

A further problem associated with film buildup on the wearcover of a prior art glass sorter is a shoveling or dozing effect created by cullet in the built-up film layer. This shoveling leaves furrows and other non-uniformities in the film layer. Prior art machines have attempted to compensate for this by slowly adjusting or re-normalizing a baseline light sensor reading, or amplitude value, over time. This has been less than satisfactory due to the non-uniformities previously discussed. Other prior art glass sorting techniques have tried to address this problem by attempting to clean the wearcover and by replacing the wearcover when the film build-up is excessive. However, cleansers have been ineffective and often leave a residue. Frequent replacement of the wearcover is expensive and leads to excessive down time of the sorting unit.

Thus, to increase the economic viability of recycling in this era of limited resources, more accurate glass sorting machines are needed. In the areas where landfill space is still relatively cheap, reducing recycle costs is perhaps even more important since the need for a landfill alternative is not as great. Additionally, increasing the quality of the final sorted product and reducing the product's cost will help shift the market from virgin raw material to post consumer material. This will reduce the need to consume the earth's limited resources. What is needed, then, is an efficient and economical method for sorting cullet by color, including the ability to distinguish blue color components. A means to compensate for non-uniform film build up over the light sensors is also needed, as is an ability to detect and correct errors due to edge refraction. An ability to distinguish ceramics from other opaque objects would be useful. Another useful capability would be to distinguish glass transparent in the visible spectrum from glass opaque in the infrared spectrum. Such "IR—opaque" glass has a different economic value than "IR—transparent" glass.

SUMMARY OF THE INVENTION

This invention relates to optical sorting of glass cullet by use of red, green and blue LED light sources, and, optionally, an infrared light source. This invention is capable of accurately identifying and sorting glass cullet based on colors having a blue component or based on yellow coloration resulting from a lack of a blue color component. Accordingly, the invention can distinguish glass colors that prior art machines could not, including purple, violet, cyan, teal, amber, yellow, and blue.

In one embodiment of the invention, glass cullet are passed between light emitting diodes and light sensors arranged to define a light sensing region. Each LED emits light of a red, green or blue wavelength. Cullet of one color will attenuate light wavelengths corresponding to other colors by different amounts than a wavelength corresponding to the same color as the cullet. By comparing the attenuation amounts of the color components, red, green, and blue, with color component intensity values of the known colors, the cullet color can be identified.

In another embodiment, a pixel grid bit map of the light sensing region is maintained in a microprocessor. The pixel grid should be sufficiently small so as to result in a substantially constant sensed light magnitude across the grid and be large enough to keep computation time to an acceptable duration. A grid size of approximately ⅛ inch square is nominally acceptable.

Each grid typically receives a red, green, and blue digital signal. A digital signal is sent from an analog-to-digital converter (A/D) which receives the analog signal from the light sensor. The light sensors have a baseline value, or amplitude, which corresponds to the magnitude of light received by the sensor when no cullet are in the light path to attenuate the light. Attenuated signals are compared against these baseline values to determine the amount of attenuation for given cullet. Thus, a pixel grid bitmap of measured color amplitudes of the cullet is generated. A microprocessor performs the color analysis, or comparison, to determine the color of the cullet. The cutlet continues down stream in the sorter to be ejected if its color matches a color chosen for ejection.

The problem of misreading colors due to film buildup, non-uniformities caused by cullet furrowing, and other non-uniformities is overcome by an embodiment of this invention. To reduce these problems, the invention re-normalizes the baseline value of the signal of the sensed light when cullet are not in the sensing region, and thus attenuating light. Prior art sorting methods simply increased—or decreased depending on the computation algorithms used—the baseline value over time. This was not fully successful due to the non-uniformities in the film layer.

One method to determine when cullet are absent from the sensing region is to take a derivative of the sensed signal. If the signal is changing, there is cullet in the sensing region and the derivative will have a value other than zero. When there is no cullet is in the sensing region, the derivative will be zero, even if the magnitude of the sensed signal has changed. When no cutlet are present, the baseline value of the signal may be re-normalized.

This will compensate for film buildup, sudden furrows, and similar non-uniformities on the wearcover in the sensing region. A typical microprocessor can operate to take the derivative and re-normalize the system. However, a discrete signal processor (DSP) is more effective. A DSP is a specialized microprocessor that is optimized for high speed numerical processing. A DSP will operate quickly enough to re-normalize the system between times that cullet are present in the sensing region even though the system is operating at a high rate of speed.

The pixel grid bitmap may also be used to compensate for edge refraction and impurity adhesion. An edge of a cullet will generally appear opaque due to edge refraction and prism effects. The cullet color will often not be accurately identified because of the opaque or darker edges. A data erosion technique using a threshold ejection footprint (or erosion footprint) is used to compensate for refraction. The footprint, which is typically adjustable, corresponds to the required number of contiguous pixel grids below which the sensed signal is ignored or suppressed. Imbedded impurities can be compensated for using the same technique.

Another embodiment of the invention employs infrared light sources and sensors capable of detecting infrared wavelengths in addition to, or independent of, the red, green, and blue light sources. The infrared wavelength is particularly useful for distinguishing cullet with paper labels from ceramics and bottle caps, and the like. IR light is better than visible (R G B) light at penetrating paper labels that may be attached to the cullet. This prevents glass with a paper label from being misidentified as opaque (ceramic).

There is a difference between the economic value of infrared opaque glass and infrared transparent glass. The difference in value can be significant. An IR light source could be used to distinguish these two types of glass.

Including infrared sources and sensors in the sensing region is quite useful and relatively simple. The red and infrared sources emit stronger signals than the green sources. The infrared sources can be retrofitted into the light source (or light array) relatively easily by alternating red and infrared sources in one row of previously all red sources. Generally intermixing the red and infrared sources is equally effective. These IR–R rows would likely be used with two rows of green sources and one row of blue sources. Again, all the sources may be intermixed and need not be separated into rows.

Use of a collimator is recommended. The collimator reduces the perceived angle of light and enhances shadow definition. The collimator generally abuts the light sources, thereby restraining the emitted light into narrow beams or channels. These narrow beams of emitted light are then interfered with and attenuated by the cullet as they pass through the beam.

An object of this invention is to provide an efficient and economical method for sorting cullet by color, including the ability to distinguish blue color components. Another object is to provide a means to compensate for non-uniform film build up over the light sensors. Yet another object is to provide an ability to detect and correct errors due to edge refraction. An ability to distinguish ceramics from other opaque objects is another object of the invention. Yet another objective is to distinguish between visibly transparent glass which is opaque in the infrared spectrum from visibly transparent glass which is transparent in the infrared spectrum.

DESCRIPTION OF THE PREFERRED EMBODIMENTS

Figure 1:
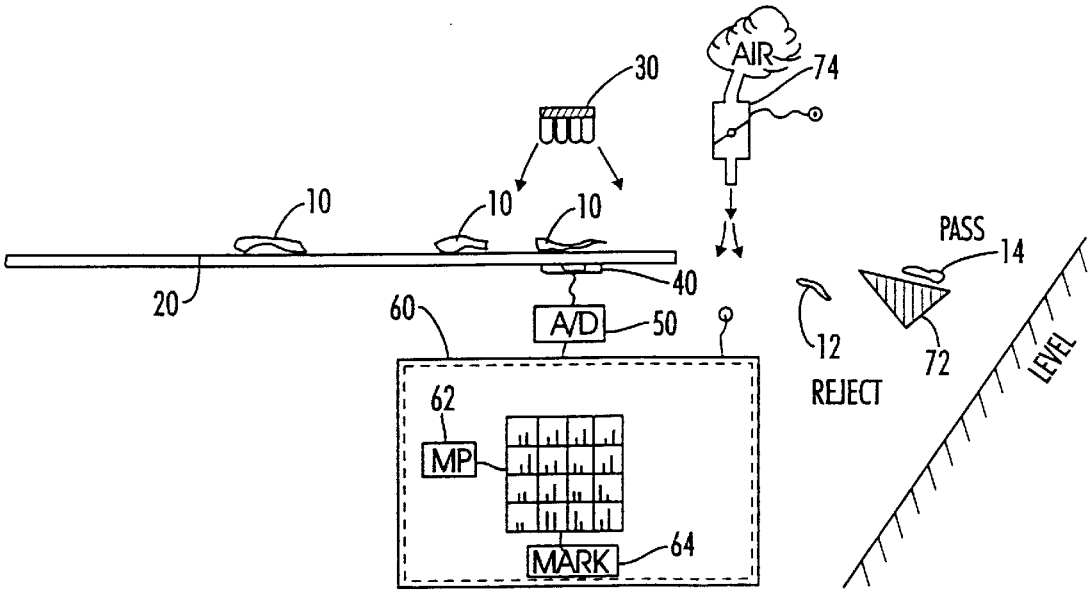
FIG. 1 (PRIOR ART)
FIG. 1 is a side elevation of a prior art glass sorting machine employing red-green light wavelengths.

The invention will be best understood when considered in light of the following description of the preferred embodiments of the invention, as illustrated in the attached drawings wherein like reference numerals and characters refer to like parts.

FIG. 1 illustrates a prior art glass sorting machine employing a red-green color sorting process. Glass cutlet 10 slides along a wearcover 20 beneath a light array, or light source, 30 and above a light sensor 40. Sensor 40 generates an analog signal corresponding to the amplitude of the light that is emitted by light source 30 that passes through the cullet 10, then reaching the sensing region proximate sensor 40.

The analog signal is transmitted to an analog-to-digital converter (A/D) 50. The digitized signal from A/D 50 is then routed to an identification module 60, including a microprocessor 62, for comparing the red and green signals to determine the color of the cullet 10. Two signal processing is used by module 60. Microprocessor 62 performs the color comparison, and a marking module 64 assigns the color to the cullet 10, or identifies the cutlet 10 with a particular color.

The cullet 10 is then identified for ejection, or not, (passed or rejected) based upon its color. As the cullet 10 moves down stream along the wearcover 20, the cullet 10 is ejected by an ejection and sorting section, if the cullet 10 was selected for ejection. The ejection and sorting section of one embodiment includes a splitter 72, and a row of air valves 74. The air valves 74 blow the rejected cullet 12 out of the cullet stream (or path), and allows the accepted cullet 14 to pass downstream. The air valves 74 are in fluid communication with an air source.

Figure 2:
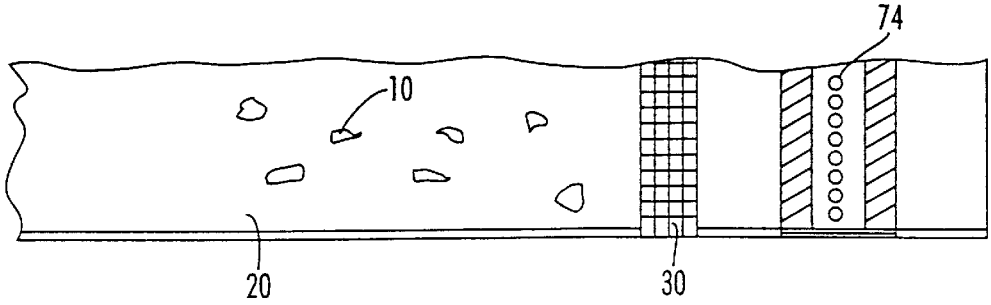
FIG. 2 (PRIOR ART)
FIG. 2 is a plan view of the prior art glass sorting machine of FIG. 1, showing a portion of the wearcover.
Figure 3:
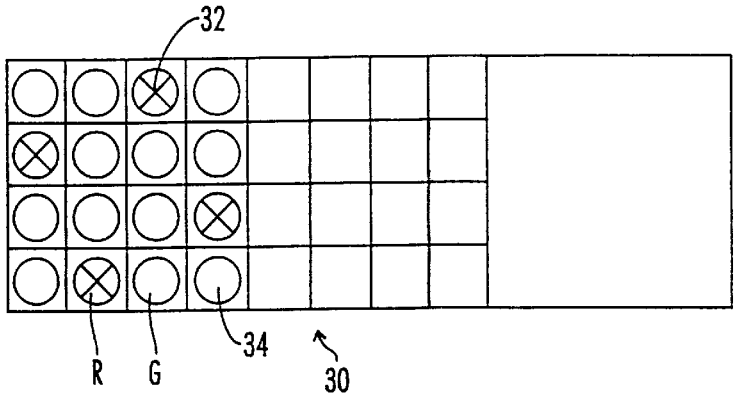
FIG. 3 (PRIOR ART)
FIG. 3 is an enlarged plan view of a typical prior art red-green light source as used in the sorting machine of FIG. 1.

FIG. 2. partially shows the glass sorter of FIG. 1 viewed perpendicular to the wearcover 20. FIG. 3 shows a typical light source array 30 as used in the prior art machine of FIG. 1, employing red and green light emitting diodes.

Figure 4:
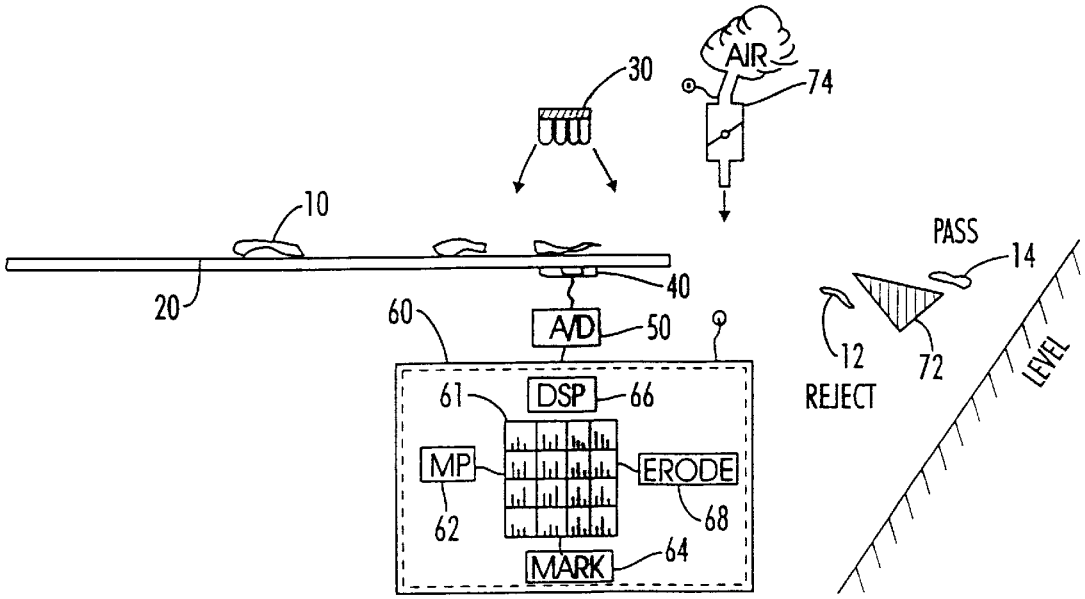
FIG. 4 is a side elevation of a first embodiment of the glass sorting machine of the present invention, employing a red-green-blue light source, a discrete signal processor, and a three wavelength signal comparison.

FIG. 4 shows a first embodiment of this invention. As in the prior art, the cullet 10 slides on a wearcover 20, passing between a light emitting source 30 and a light sensing array, or sensor, 40 positioned across the sensing region of the machine. Analog signals from the sensor 40 are passed to analog-to-digital converter 50; then the digitized signal is passed to a color identification (ID) module 60. A signal generating module in the sensor 40 may be used to generate the signals corresponding to the magnitude of light sensed. In one embodiment, the color ID module 60 maintains a pixel grid map 61 of the sensing area. Alternatively, the color ID module 60 includes a pixel grid mapping module, where the pixel grid mapping module digitally maps the sensing region and the cullet 10. When the cullet 10 passes through the sensing region, a pixel grid bitmap of the cullet 10 is created in a microprocessor 62, or a similar module. Typically, a digital signal processor 66 is used to determine the presence or absence of cullet 10 in the sensing region by taking the derivative of the sensed signal.

Microprocessor 62 determines the color of the cullet 10 by analysis or comparison. Use of a "look up" table is one method for comparing the data. Vector analysis, however, is typically preferred. The amplitudes of the signals generated by the light sensor 40 are analyzed with baseline values to determine a transmission value. The transmission value generally ranges from total color to total darkness. Thus, a transmission value is generated corresponding to each sensed red, green, or blue, or infrared color light.

Modules may be used as an alternative to, or in conjunction with, the microprocessor. A transmission module may be used to analyze the baseline values and amplitudes of the attenuated signals to assign red, green, or a blue transmission value which corresponds to the wavelength (and intensity) of the light sensed. A color module may be used to determine the color of the cullet based upon the transmission values.

The color module may include a category module to assign a color category to the cullet 10. Each assignable color category would typically include a red, a green, and a blue threshold setting. The cullet 10 would be assigned the color category within whose threshold settings its transmission values fall. For instance, assuming a color category A had threshold parameters set to range from X to Z and that a transmission value of a cullet were Y, where Y is between X and Z, then the cullet would be assigned color category A.

This example is one dimensional, but the invention is capable of functioning in multiple dimensions. Use of red, green, and blue would typically require three transmission values. Inclusion of infrared would generally require a fourth transmission value. Each color category that may be assigned typically includes these three, or four, color components. The amount, or intensity, of the color component is measured by the transmission values (ranging from total color to total dark).

The 'modules' referred to are intended to mean any means that can perform the function the module is intended to accomplish. They may be combined or separated. Thus, reference to one module does not, typically, prohibit that module from performing other functions carried out by other modules. Typically a microprocessor can, and does, carry out multiple functions ascribed to various modules. Thus, the modules may be implemented in software, firmware, hardware, or combinations of these.

Marking module 64 marks a particular grid for ejection if the assigned color of that grid matches a color selected for ejection. Data erosion module (erode module) 68 is used to erode data caused by refraction and other discontinuities in a cullet bitmap. The signal is then routed to the ejection section to eject cutlet 10 marked, or selected, for ejection.

The ejection section of the preferred embodiment includes a splitter 72, and a row of air valves 74. The air valves 74 blow the rejected cullet 12 out of the cutlet stream, and allow the accepted cullet 14 to pass downstream.

Figure 5:
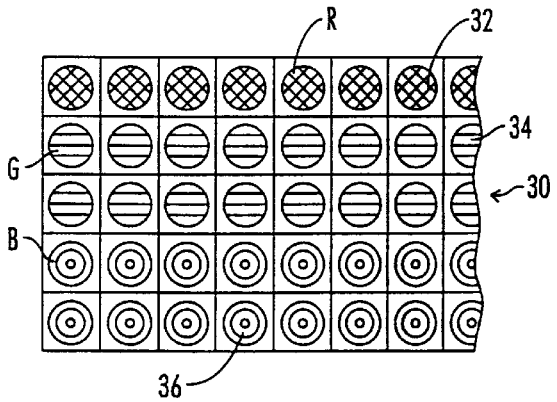
FIG. 5 is an enlarged plan view of the red-green-blue light source used in the glass sorting machine of FIG. 4.
Figure 6:
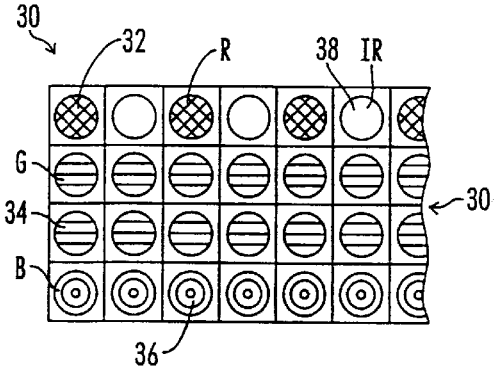
FIG. 6 is an enlarged plan view of an infrared-red-green-blue light source for use in the glass sorting machine of FIG. 7.

FIG. 5 shows a configuration for a light source 30 including red LED's R, green LED's G, and blue LED's B, arranged in an array. FIG. 6 illustrates another embodiment of light source 30, further including an infrared emitting source IR.

Figure 7:
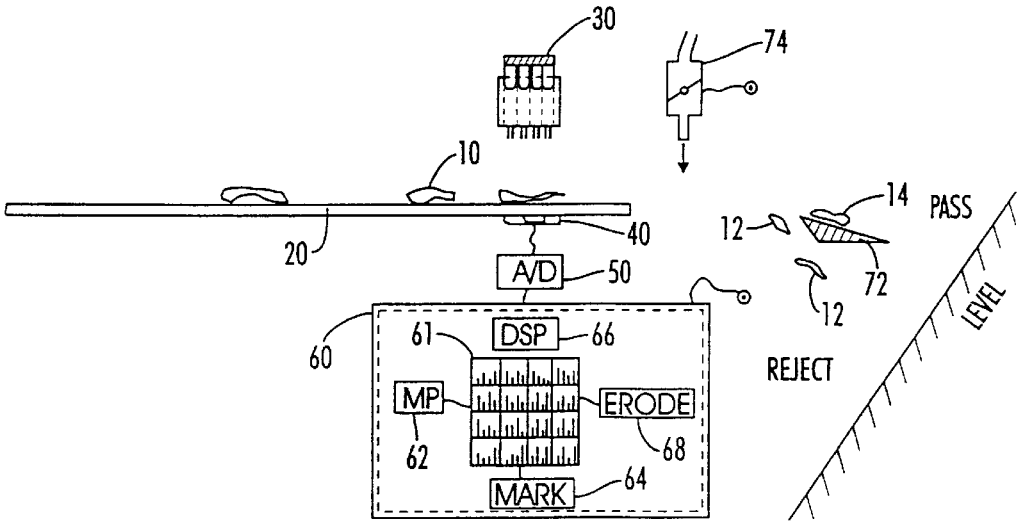
FIG. 7 is a side elevation of a second embodiment of the glass sorting machine of the present invention employing, an infrared-red-green-blue light source, a collimator, a digital signal processor and four wavelength signal analysis.

FIG. 7 is a side elevation of another embodiment of the machine of this invention, showing the use of collimator 80 to reduce the perceived angle of light and enhance the definition of a shadow created by cullet 10 when it passes through the sensing area above the light sensor 40. Pixel grid map 61 depicts signal processing of four signals, representing the processing of red, green, blue and infrared signals.

One preferred embodiment of this invention relates to an optical glass sorting machine for sorting glass cullet by color. This includes sorting ceramics with infrared light as well. Typically the glass is intermixed with impurities such as dirt, sand, bottle caps, and other opaque material because the glass cullet are, generally, trash to be recycled, or further processed, after sorting. It is not economically feasible to pre-clean the glass cullet. Thus, film buildup from the impurities tends to distort sensed light magnitude readings. The preferred embodiment attempts to overcome this sensing inefficiency through a re-normalization, or normalizing, process.

A more fundamental shortcoming of the prior art is its inability to distinguish blue colors. Hence, any cutlet containing a blue component was either erroneously discarded, or mistakenly accepted and intermixed, or processed, with recycleables. Discarded cullet were equivalent to throwing money away. Mis-sorted and mis-processed pieces reduced the quality, purity, and hence value, of the recycled lot because mis-sorts were mixed in with the desired color. One preferred embodiment overcomes this fundamental short coming by adding blue color detecting capability to optical sorting machines. Colors such as magenta, teal, yellow, cyan, blue, and the like are now distinguishable.

In one preferred embodiment, glass cullet 10 slide over a wearcover 20. The wearcover 20 is oriented generally at a 45 degree angle to a horizontal plane. Cullet 10 pass between a light source 30 and a light sensor 40. The light source 30 in one preferred configuration is an array of light emitting diodes (LED's) comprising a row of blue LED's 36, two rows of green LED's 34, and a row of red LED's 32, intermixed with infrared LED's 38. The red and infrared LED's emit a stronger signal than the green LED's. Hence, the same red and infrared detection capability can be obtained with fewer sources than would be required for green detection capability.

A collimator 80 abuts the light source 30 and is used to reduce the perceived angle of light, constrain the light, and thereby enhance the definition of a shadow created when a cullet 10 passes through the light rays.

Different color cullet 10 will attenuate a signal corresponding to colored light received by the sensing array 40 different amounts. These sensed signals are converted to digital by an analog-to-digital converter 50.

These signals have a baseline value corresponding to when cullet is not attenuating the signal. A discrete signal processor (DSP) 66 is used to determine if cullet are present in the sensing field. The DSP 66 determines the presence or absence of a cullet by calculating the derivative of the signal. If the signal is non-zero, cullet is present.

When cullet are absent, the DSP 66 re-normalizes (or normalizes) the baseline value for a given signal (e.g. red, green, blue, or infrared). A DSP is used because it can make the computations quickly enough to re-normalize the baseline value between times when cullet are present in the sensing region, even when the sorter is operating at a high rate.

The microprocessor 62 compares the attenuated signal against the re-normalized baseline value to determine the intensity of that wavelength of signal, or that component of color, as a result of cullet attenuation.

A pixel grid map 61 of the sensing field is typically maintained in the microprocessor 62. Each grid is an approximately ⅛ inch square. When cullet 10 passes into the sensing region, a pixel grid bitmap of it is created. Red, green, blue and infrared intensity values are determined for each grid. Vector analysis is used to determine the color to assign to that grid. If the grid color matches a color selected for ejection, marking module 64 marks it for ejection. It will be apparent to those skilled in the art of sorting that such 'marking' may simply be timing when to operate the ejector. Also, pixel grid mapping modules and color modules may be used as alternatives to the microprocessor.

An erosion module 68 used is to reduce false readings, or spurious measurements, due to refraction, small impregnated impurities, and other discontinuities. The erosion module 68 suppresses ejection selection for grids in a contiguous footprint when the footprint falls below an adjustable threshold. As an example, the footprint threshold may be adjusted to five, so that data contained in grids that form a contiguous footprint less than five will be suppressed. If the cullet 10 has edge refraction that causes two grids to appear opaque, the data for those two grids will be suppressed. Data suppression may be as simple as not responding to the data, or it may be processing the 'suppressed data' in an alternative manner to account for the discontinuity in the data.

As the cutlet 10 slide downstream on the wearcover 20, those selected for ejection will be ejected by an ejection section. The ejection section of one embodiment includes a splitter 72, and a row of air valves 74. The air valves 74 blow the rejected cullet 12 out of the cutlet stream, and allow the accepted cullet 14 to pass downstream.

One method of operating the LED light source 30 is to emit one color of light, then another color, then another. For example, the light source 30 may be activated to emit all green light, then all red light, and then all blue light. More specifically, the sorting sequence of one embodiment uses one sensor multiplexed as follows: IR LED on, read sensor 40 to obtain IR value, IR LED off; red LED on, read sensor 40 to obtain red value, red LED off; green LED on, read sensor 40 to obtain green value, green LED off; blue LED on, read sensor 40 to obtain blue value, blue LED off. This is executed sufficiently fast that for sorting purposes, the readings (IR, Red, Green, Blue) can be considered to be simultaneous. Thus, the LED's in light source 30 should have the ability to operate independently or simultaneously.

The algorithm to analyze color is optimized for computability with limited processing power. In one embodiment, an analytical method to detect several broad category colors is used. No attempt is made to detect or classify infinite variations of shade and hue. Identification of the major color categories is sufficient for glass cullet sorting. These colors, or color categories, are generally red, green, blue, cyan, magenta, yellow, clear, gray, and opaque.

These color categories may be roughly computed using addition and subtraction. Given the red, green, and blue color transmission values from the sensor 40, (R, G, and B), the method computes or derives a variable that represents each category. For example, to detect red, the method computes a variable called "Redness", where Redness=R-B+R-G. Redness is the extent to which the red transmission is higher than blue or green. If the computed variable (Redness) is greater than a certain adjustable threshold, then the pixel (or pixel grid of the map or bit map) would be assigned a color of red. A particular reading or pixel may be computed to be two or more colors, for example, brown cullet might register as yellow and red at once, depending on the threshold settings.

For each incoming color reading, i.e., sensing of color light, INPUT, (red, green, blue, or infrared), the method produces a corresponding scale factor, K, such that K*INPUT=100% when there is no cullet 10 passing over the sensor 40. When cullet 10 passes over the sensor 40, the signals drop to something less than 100%, depending on the color of the cullet piece. The scale factor K is adjusted slowly over an appropriate period of some fraction of a second, so that it is maintained at the correct value. Thus, all color readings are normalized to read 100% at full scale. The algorithm for adjusting K to the correct value is designed according to the following rules:

1. If the current signal derivative is non-zero, then the method assumes a cullet piece is currently passing the sensing region proximate sensor 40, and K is not adjusted.
2. If the current signal derivative is 0 (zero) or close to 0, then the method assumes the sensing region is clear, and K is slowly adjusted either up or down. If K*INPUT<100% then K is increased. If K*INPUT>100% then K is decreased.

Thus, all color signals are quickly normalized to 100% and therefore all computed colors are nulled to zero when there is no cullet 10 passing over the sensor 40.

Thus, although there have been described particular embodiments of the present invention of a new and useful "Optical Glass Sorting Machine and Method," it is not intended that such references be construed as limitations upon the scope of this invention except as set forth in the following claims.

What is claimed is:

1. A machine for sorting glass cullet according to different color characteristics of the cullet comprising:

a. a light source including an emitter of blue light;

b. a sensor adapted to generate a blue light electrical signal in response to a magnitude of the blue light passing through the glass cutlet to the sensor when the cullet is positioned between the light source and the sensor;

c. a color identification module operably connected to the sensor and responsive to the blue light electrical signal whereby the magnitude of the blue light passing through the cullet is used to identify the cullet with one or more of the different color characteristics, including blue color characteristics;

d. the light source further including an emitter of red light and an emitter of green light;

e. the sensor further adapted to generate red and green light electrical signals in response to magnitudes of the red and green light passing through the glass cullet to the sensor when the cullet is positioned between the light source and the sensor;

f. the color identification module is responsive to the red and green light electrical signals whereby the magnitudes of the red and green light passing through the cullet are also used to identify the cullet with one or more of the different color characteristics; and g. the sensor including a signal generating module for generating the red, green, and blue light electrical signals, the red, green, and blue light electrical signals having baseline values and amplitudes, the baseline values and amplitudes corresponding to the magnitudes of the respective red, green, and blue light sensed by the sensor, and the color identification module including a transmission module for analyzing the amplitudes and the baseline values and assigning a red, a green, or a blue transmission value corresponding to the magnitudes of the red, green, or blue light sensed by the sensor, the transmission module responsive to the red, green, and blue light electrical signals, and a color module for determining the color characteristics of the cullet by analyzing the transmission values, the color module responsive to the transmission values.

2. The glass sorting machine of claim 1, wherein the color module includes a category module for assigning a color category to the cullet, the color category including red, green, and blue threshold settings, where the color module assigns the color category according to a comparison between the threshold settings and the transmission values of the cullet.

3. The glass sorting machine of claim 1 further comprising:

a. the color identification module including a pixel grid map module to map a sensing region between the light source and the sensor such that the pixel grid map module maps the cullet as the cullet pass through the sensing region, the pixel grid map module responsive to the red, green, and blue light electrical signals; and b. the color identification module further including a normalizer adapted to normalize the baseline values between times when cullet are present in the sensing region, the normalizer responsive to the red, green, and blue light electrical signals.

4. The glass sorting machine of claim 3 further comprising:

a. the red, green, and blue light electrical signals comprise analog signals;

b. an analog-to-digital (A/D) converter to convert the analog signals to digital signals; and c. the pixel grid map module being responsive to the digital signals such that red digital signals, a green digital signals, and blue digital signals corresponding are mapped, the digital signals having baseline values in the absence of cullet in the sensing region and attenuated values in the presence of cullet in the sensing region;

d. the normalizer having a discrete signal processor (DSP) adapted to normalize the digital signal baseline values between times when cullet are present in the sensing region, wherein the DSP is adapted to determine the presence or absence of cullet in the sensing region by taking a derivative of the digital signals, and where the DSP is responsive to the digital signals; and e. an erosion detection module to detect spurious measurements due to refraction and other irregularities, where the erosion module suppresses data based upon an erosion footprint threshold and the erosion detection module is responsive to the digital signals.

5. The glass sorting machine of claim 4 further comprising:

wherein the infrared, red, green, and blue LED light sources may be operated independent of one and another;

b. a collimator aligned with the light source such that the light is restrained; and c. an ejector in operable position to eject the cullet in response to ejection signals generated by the color identification module.

6. A method for sorting cullet by color, where the cullet comprises substantially glass articles having different color characteristics intermixed with optical impurities comprising the steps of:

a. directing light having red, green, and blue light components from a light source to a light sensor positioned so that articles passing between the light source and sensor can attenuate the light before it reaches the sensor;

b. sensing in the sensor the red, green, and blue light components and generating corresponding signals, the signals having attenuated amplitude values and baseline values, the attenuated amplitude values corresponding to the red, green, and blue light components attenuated by the articles, and the baseline values corresponding to red, green, and blue light components not attenuated by the articles;

c. conveying the articles through the light such that the light reaching the sensor is attenuated; and d. distinguishing the color characteristics of the articles based upon the attenuated amplitude values of the signals, the distinguishing including determining a transmission value for each red, green, or blue light component sensed, setting a red, a green, and a blue threshold setting for each color characteristic, determining the color characteristic for each article by comparing the red, green and blue transmission values for each article to the red, green and blue threshold setting corresponding to each color characteristic.

7. The sorting method of claim 6 further comprising:

a. directing light having an infrared component from the light source to the light sensor so that articles passing between the light source and sensor can attenuate the infrared component of the light before it reaches the sensor;

b. sensing the infrared light component in the sensor and generating corresponding infrared light signals; and c. separately obtaining the transmission values associated with the infrared, red, green, and blue light components by sequentially and individually emitting and sensing the infrared, red light, blue light, and green components.

* * * * *

UNITED STATES PATENT AND TRADEMARK OFFICE

CERTIFICATE OF CORRECTION

PATENT NO. : 6,504,124 B1
DATED : January 7, 2003
INVENTOR(S) : Doak

It is certified that error appears in the above-identified patent and that said Letters Patent is hereby corrected as shown below:

Column 1,
Line 25, insert -- . -- after "thereof".

Column 3,
Line 17, replace "cutlet" with -- cullet --.

Column 4,
Line 67, replace "cutlet" with -- cullet --.

Column 5,
Line 13, replace "cutlet" with -- cullet --.

Column 6,
Line 32, replace "cutlet" with -- cullet --.

Column 8,
Line 1, replace "cutlet" with -- cullet --.

Column 9,
Line 13, replace "cutlet" with -- cullet --.

Column 10,
Line 33, insert -- a. -- before "wherein".

Signed and Sealed this

Eighth Day of April, 2003

JAMES E. ROGAN
*Director of the United States Patent and Trademark Office*